US009053885B2

(12) United States Patent
Gassmann et al.

(10) Patent No.: US 9,053,885 B2
(45) Date of Patent: Jun. 9, 2015

(54) BISTABLE HIGH-PERFORMANCE MINIATURE RELAY

(75) Inventors: Jörg Gassmann, Dresden (DE); Steffen Schnitter, Dresden (DE); Marcus Herrmann, Dresden (DE); Matthias Kulke, Dresden (DE)

(73) Assignee: Johnson Electric Dresden GMBH, Dresden (DE)

( * ) Notice: Subject to any disclaimer, the term of this patent is extended or adjusted under 35 U.S.C. 154(b) by 132 days.

(21) Appl. No.: 13/641,736

(22) PCT Filed: Apr. 11, 2011

(86) PCT No.: PCT/DE2011/000395

§ 371 (c)(1),
(2), (4) Date: Dec. 20, 2012

(87) PCT Pub. No.: WO2011/131168

PCT Pub. Date: Oct. 27, 2011

(65) Prior Publication Data

US 2013/0093544 A1 Apr. 18, 2013

(30) Foreign Application Priority Data

Apr. 21, 2010 (DE) ..... 10 2010 017 872

(51) Int. Cl.
*H01H 51/22* (2006.01)
*H01H 67/02* (2006.01)
(Continued)

(52) U.S. Cl.
CPC ..... *H01H 45/04* (2013.01); *H01H 1/26* (2013.01); *H01H 50/042* (2013.01); *H01H 51/12* (2013.01); *H01H 51/2272* (2013.01)

(58) Field of Classification Search
CPC .... H01H 51/2272; H01H 50/24; H01H 51/01
USPC ..... 335/79, 128, 136, 177, 179
See application file for complete search history.

(56) References Cited

U.S. PATENT DOCUMENTS 2,941,130 A * 6/1960 Krautwald et al. ..... 335/230
2,985,735 A * 5/1961 Bede ..... 335/179
(Continued)

FOREIGN PATENT DOCUMENTS

DE 2148377 A1 4/1973
DE 37 21 286 A1 1/1989
(Continued)

OTHER PUBLICATIONS

International Search Report with Written Opinion for PCT/DE2011/000395 mailed Aug. 11, 2011.

*Primary Examiner* — Mohamad Musleh
(74) *Attorney, Agent, or Firm* — Cohen & Hildebrand, PLLC

(57) ABSTRACT

Bistable high-performance miniature relay, comprising an insulating housing having a first housing chamber (1*b*) with a single-phase contact assembly (4) with two current bars (8*a*, 8*b*) and a contact spring (13). The contact spring (13) being permanently connected with one leg end a current bar (8*a*). In a second housing chamber (1*a*), a bistable magnetic actuator assembly (3) with a pivotable armature (11) is placed. The contact assembly (4) and the actuator assembly (3) are located in one or two planes in the insulation material housing, the contact assembly (4) is provided with a multiplate contact spring (13) bent U-shaped to a current loop, and the actuator assembly (3) is provided with a one-part U-shaped yoke (14) with an excitation coil (17) per yoke leg and a yoke central leg (16), borne by a flat permanent magnet, supporting a rocker armature (11) formed in a slightly V-shaped.

10 Claims, 7 Drawing Sheets

(51) Int. Cl.

| | |
|---|---|
| ***H01H 9/00*** | (2006.01) |
| ***H01H 45/04*** | (2006.01) |
| ***H01H 1/26*** | (2006.01) |
| ***H01H 51/12*** | (2006.01) |
| *H01H 50/04* | (2006.01) |

(56) References Cited

U.S. PATENT DOCUMENTS

| | | | | | |
|---|---|---|---|---|---|
| 3,001,049 | A | * | 9/1961 | Didier | 335/136 |
| 3,265,827 | A | * | 8/1966 | Scata | 335/79 |
| 4,159,455 | A | * | 6/1979 | Bosch et al. | 335/79 |
| 4,344,103 | A | * | 8/1982 | Nagamoto et al. | 361/160 |
| 4,855,699 | A | * | 8/1989 | Hoegh | 335/177 |
| 4,912,438 | A | * | 3/1990 | Yokoo | 335/78 |
| 5,063,364 | A | * | 11/1991 | Tsoi | 333/107 |
| 5,548,259 | A | * | 8/1996 | Ide et al. | 335/78 |
| 5,886,601 | A | * | 3/1999 | Kitamura et al. | 335/129 |
| 6,124,771 | A | * | 9/2000 | Kim et al. | 335/4 |
| 6,661,319 | B2 | | 12/2003 | Schmelz | |
| 6,788,176 | B2 | | 9/2004 | Schmelz | |
| 7,307,499 | B2 | * | 12/2007 | Nakamura et al. | 335/78 |
| 7,495,535 | B2 | * | 2/2009 | Mikl | 335/78 |
| 7,696,846 | B2 | * | 4/2010 | Maier et al. | 335/201 |
| 8,008,999 | B2 | * | 8/2011 | Morimura | 335/78 |
| 2003/0112103 | A1 | | 6/2003 | Schmelz | |
| 2009/0231070 | A1 | * | 9/2009 | Saruwatari et al. | 335/179 |
| 2012/0182097 | A1 | * | 7/2012 | Moeller et al. | 335/71 |

FOREIGN PATENT DOCUMENTS

| | | | | |
|---|---|---|---|---|
| DE | 19820821 | C1 | | 12/1999 |
| DE | 101 62 585 | C1 | | 4/2003 |
| DE | 10249697 | B3 | | 4/2004 |
| EP | 2 131 377 | A1 | | 12/2009 |
| FR | 2 491 254 | A1 | | 4/1982 |
| GB | 908166 | A | * | 10/1962 |

* cited by examiner

BISTABLE HIGH-PERFORMANCE MINIATURE RELAY

This is an application filed under 35 USC §371 of PCT/DE2011/000395 filed on Apr. 11, 2011 and claiming priority to DE 10 2010 017 872.1 filed on Apr. 21, 2010.

BACKGROUND OF THE INVENTION

The invention relates to a bistable high-performance miniature relay, comprising a housing made of an insulation material with a first housing chamber in which a single-phase contact assembly with two current bars and a contact spring is arranged, with the contact spring permanently connected with one leg end to one of the current bars and with the other free leg end, bearing at least one mobile contact, works to at least one fixed contact that is seated on the second current bar, wherein in a second housing chamber a bistable magnetic actuator assembly with a pivotable armature is placed that over a driving device located in the housing displaces the contact spring in order to close or break an electric circuit over the current bars.

Such a generic miniature relay, for example, is known from DE 10 2007 011 328 A1. In this relay the actuator assembly is placed in a housing chamber above a housing chamber for the contact assembly, with both housing chambers having different dimensions. Therefore the elongated contact spring is required. The actuator is provided with a so-called H-armature, comprising two parallel soft iron armature plates between which a permanent magnet is clamped magnetized such that the one pole is directed toward the one armature, the other pole toward the other armature. The H-armature is supported by a pivot bolt in the housing chamber of the actuator, pivoting between two sections directed toward each other of two yoke components of the magnetic circuit depending upon the excitation pulse of a solenoid coil with changeable polarity. The bolt bearing causes friction. The H-armature has a radially protruding arm reaching under a contact spring that is elongated on the whole, thus displacing the contact spring.

BRIEF SUMMARY OF THE INVENTION

The invention is based on the problem to develop a bipolar electrical miniature relay having a switching power within the range of 100 A or more that is easy to manufacture, easily adaptable to specified conditions of use and consumes only little switching energy.

The problem is solved by the features of claim 1. Advantageous further developments and embodiments are given by the accompanying claims.

Due to its modular structure the relay according to the invention can be configured extremely variable to meet very different requirements of installation. The simple and automation-friendly components and the suitable division into an actuator assembly and a contact assembly reduce production costs. Other advantages are the small installation space with high power, and the option to minimize either the installation height or the installation width while using the same assemblies. The relay enables high switching frequencies and distinguishes itself by low contact chatter, very low contact resistance, low internal power consumption, little switching energy, long life and fast contact parting in case of a short circuit.

BRIEF DESCRIPTION OF THE DRAWINGS

The invention will become apparent upon reading the following detailed description of an example of embodiment. In the accompanying drawings it is shown by.

DETAILED DESCRIPTION OF THE INVENTION

Figure 1:
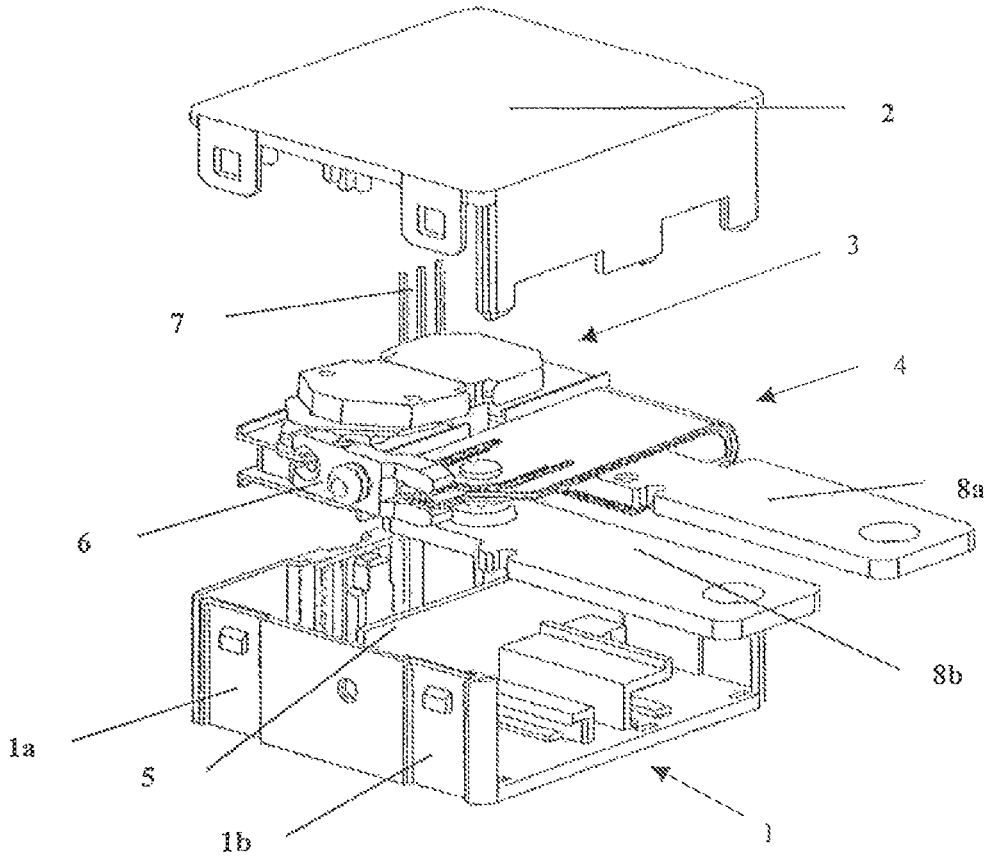
FIG. 1 a bistable relay with an insulation material housing removed.

FIG. 1 shows a first embodiment of a bistable relay according to the invention with the insulation material housing removed. The insulation material housing comprises a square housing bottom part 1 and a square housing cap 2 that enclose between each other an actuator assembly 3 and a contact assembly 4 located adjacent to the actuator assembly 3. A partition 5 divides the housing bottom part 1 into two approximately same size housing chambers 1*a*, 1*b*. The one chamber 1*a* accommodates the actuator assembly 3 by form closure, the other chamber 1*b* accommodates the contact assembly 4 by form closure, with internal housing contours not shown in the insulation material housing serving for that. The actuator assembly 3 actuates the contact assembly 4 via a driving device reaching over the chambers 1*a*, 1*b*. With the insulation material housing closed, only three connector pins 7 are brought out for the control of the actuator and two current bars 8*a*, 8*b* for the consumer current to be switched, the ends of which can be configured depending upon the use of the relay. For example, the relay can be a component of an intelligent electronic energy meter.

Figure 2:
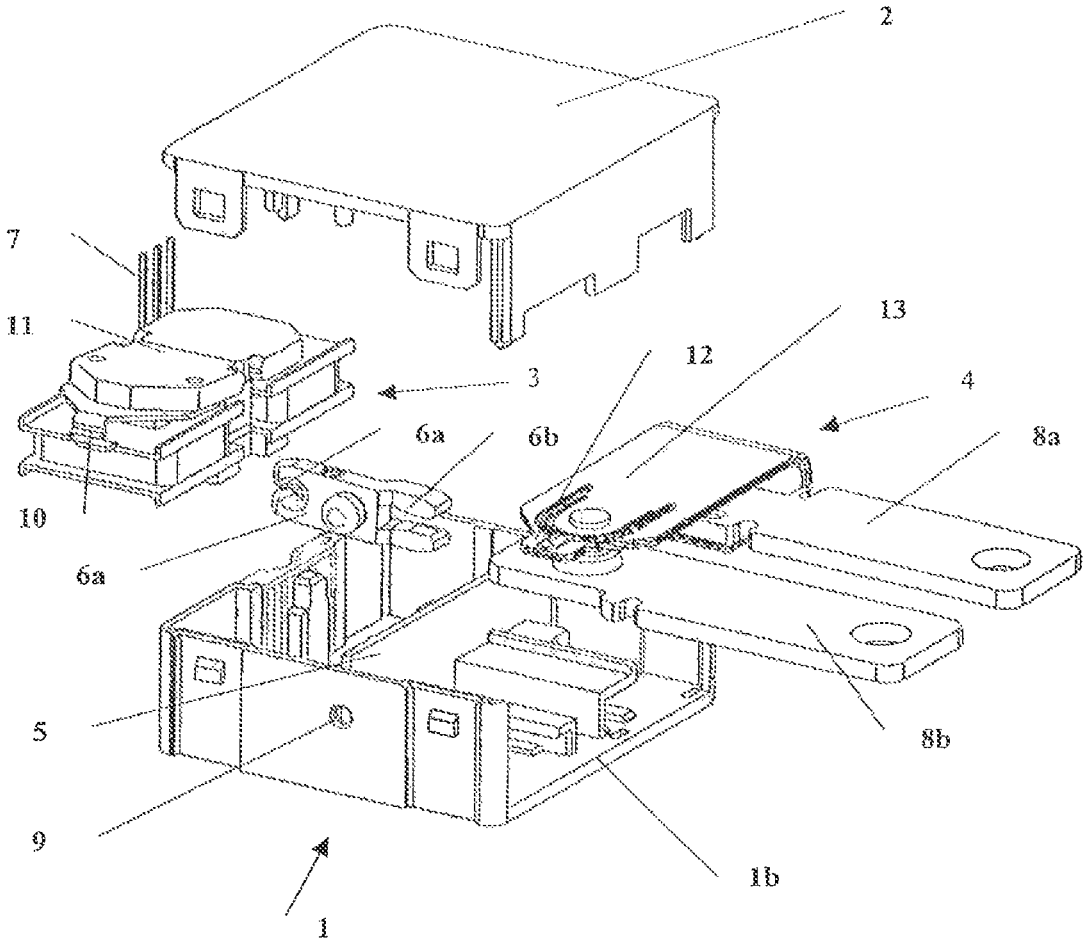
FIG. 2 a relay to FIG. 1 dismantled into assemblies.

FIG. 2 shows the same establishment of a relay, again with the insulation material housing removed, with the actuator assembly 3, the contact assembly 4 and the driving device shown separated from each other for better visibility of details. In the relay version shown, the driving device is established as rotative double-arm rocker element 6 supported in the insulation material housing. A hole 9 is provided, centered at the level of the partition 5 of the housing chambers 1*a*, 1*b* in the housing bottom part 1, to support the rocker element 6. Using a gripper arm 6*a* the rocker element 6 grips a force application member 10 of a rocker armature 11 of the actuator assembly 3, using the other gripper arm 6*b* a force application member 12 of a contact spring 13 of the contact assembly 4. Both gripper arms 6*a*, 6*b* are equal in length so that same force-way ratios follow. But also other lever ratios are possible.

Figure 3:
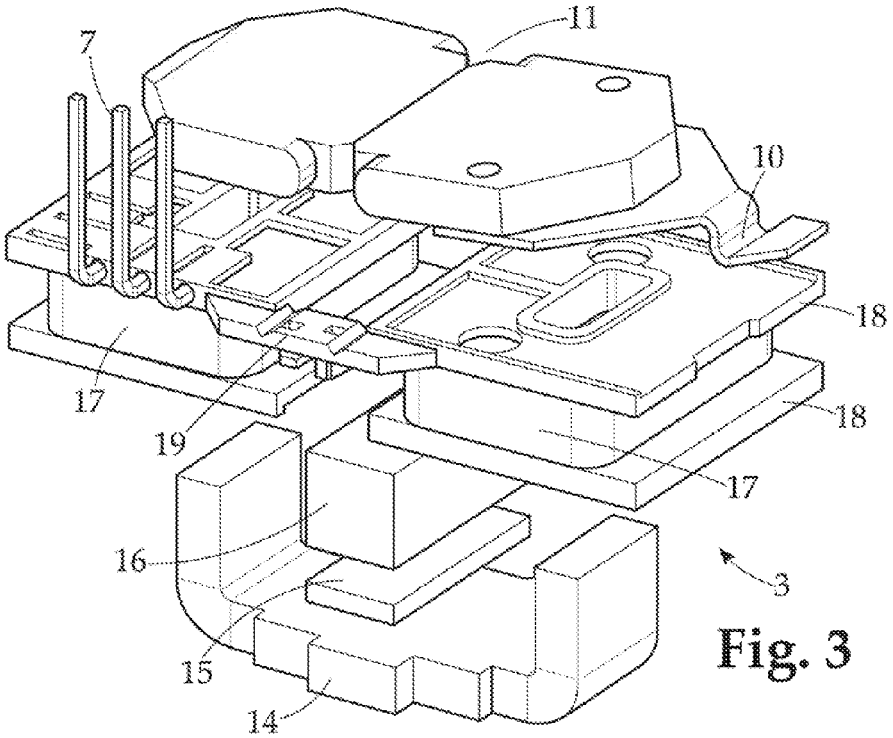
FIG. 3 an actuator assembly in explosive view.

In FIG. 3 an actuator assembly 3 is shown detailed in an explosive view. A U-shaped yoke 14 is one-part with both yoke legs stamped and bent from soft iron sheet. On the central part of the yoke 14 a flat permanent magnet 15 is arranged, bearing a soft iron central leg 16. So an E-shaped magnetic core is formed. On the outer yoke legs there are separately controllable excitation coils 17 carried by an insulating body 18. The insulating bodies 18 of the excitation coils 17 are connected by one or several film hinges 19, therefore can be wound in one operation while bringing out the inner line ends. The inner line ends are soldered to one of the three connector pins 7, the outer line ends separately to the other two connector pins 7. On the central leg 16 the slightly V-shaped rocker armature 11 is knife-edge mounted. Such an armature support is very poor in friction, therefore requires only little control power. The magnetic force of the extremely flat permanent magnet 15 is sufficient to hold all four magnetic components 14, 15, 16 and 11 without any other fastening means, excepting a lateral guide of the rocker armature 11 at the insulating body 18. At a wing of the rocker armature 11 the force application member 10 for the gripper arm 6*a* of the double-arm rocker element 6 is mounted or formed on. Depending upon the switching position of the rocker armature 11 the relay closes or breaks a load circuit led over the two current bars 8*a*, 8*b*.

Figure 4:
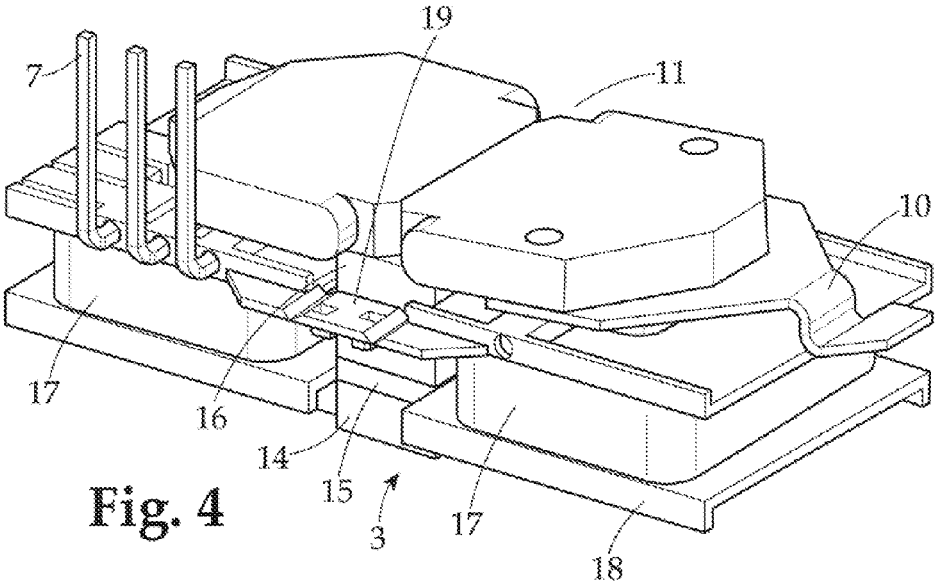
FIG. 4 the actuator assembly to FIG. 3 in assembled condition.

In FIG. 4 the actuator assembly 3 is again shown in assembled condition, with the same reference marks used for equal-function components like in all other drawings. The specially flat design of the actuator assembly 3 and the small number of components is seen.

In a preferred version the actuator assembly 3 is controlled over the connector pins 7 such that for switching over the rocker armature 11 from one switching position into the other the permanent magnetic holding flux through the parallel magnetic circuit closed over the rocker armature 11 commutates at an electromagnetic control flux generated by the excitation coil 17 of this magnetic circuit at a direction opposed to the permanent magnetic holding flux into the other parallel magnetic circuit that carries the unexcited excitation coil 17. For switching over, always that excitation coil 17 is driven that is in the magnetic circuit with the attracted armature wing of the rocker armature 11. This reduces the driving power.

Figure 5:
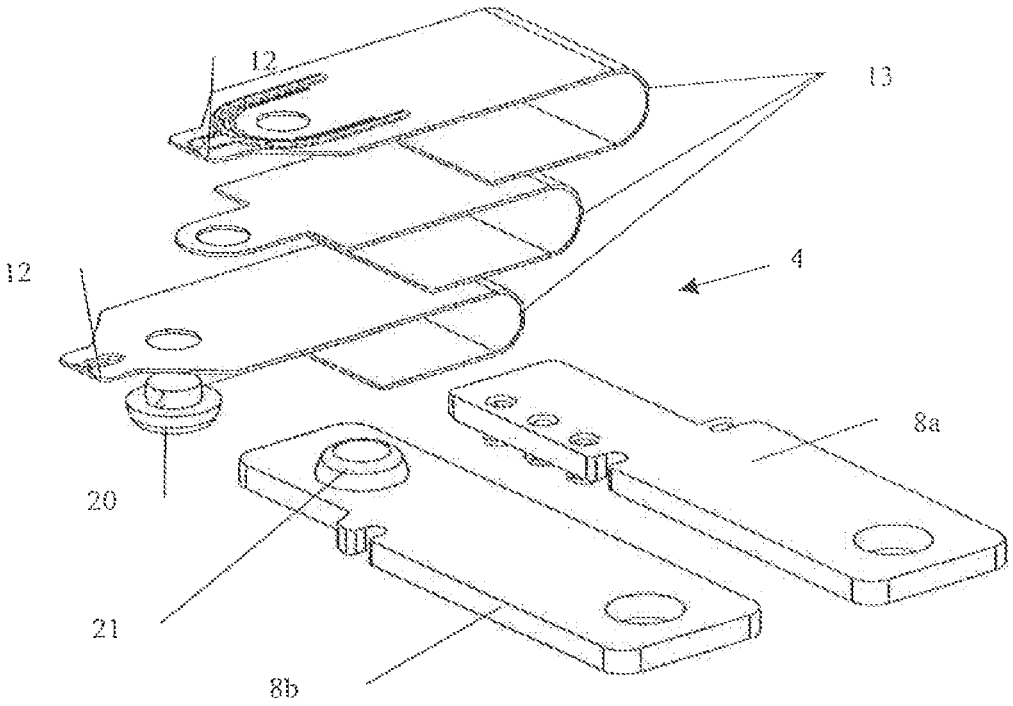
FIG. 5 components of a contact assembly in explosive view.

FIG. 5 shows a version of the contact assembly in an explosive view. Three plates of a contact spring 13 bent in U-shape are shown. The three plates of different length are solely at their ends mechanically and electrically connected to each other. The shorter U-legs are attached with their ends to one of the current bars 8*a*, the longer ends bear a movable contact 20 that interacts with a fixed contact 21 on the other current bar 8*b*. Formed at the free ends of the upper and lower contact spring plates there are force application members 12 in form of cut-out flexible tongues serving as application point of a driving device. Shape elements not shown in detail of the current bars 8*a*, 8*b* engage with corresponding shape elements in the housing chamber 1*b* of the housing bottom part 1 to make a form closure. In addition, both ends of the current bars 8*a*, 8*b* are configured to enable conductors to be connected.

Figure 6:
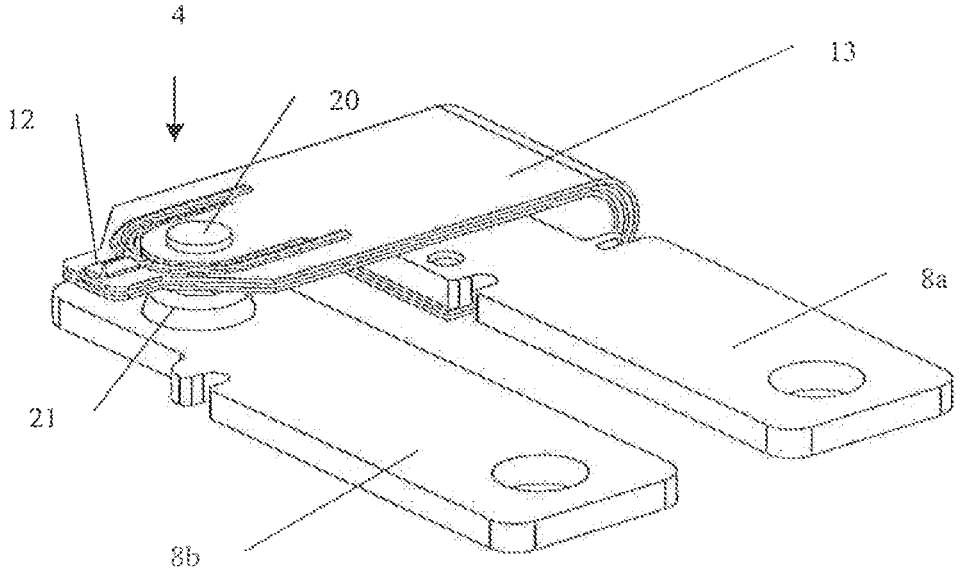
FIG. 6 the components to FIG. 5 in assembled condition.

In FIG. 6 a contact assembly 4 is again drawn in assembled condition. The U-shape of the contact spring 13 allows to achieve a force-way characteristic well-tuned to the actuator, despite of the short design length and high current carrying capacity required. The requirement is supported by the multiplate structure of the contact spring 13, while it is advantageous for heat removal, length compensation of manufacture tolerances, length compensation of thermal expansion of the plates and flexibility of the contact spring 13, if in the U-bending zone the single plates fan out in a self-aligning manner. It can also be provided that the single plates have different spring and conductivity properties. Due to the U-shape of the contact spring 13 the current flows through the contact spring sections, that are parallel next to the other, of the U-legs in opposite directions so that in case of a short-circuit current the contacts 20, 21 advantageously are broken at a low delay by the electrodynamic forces acting on the contact spring 13.

Figure 7:
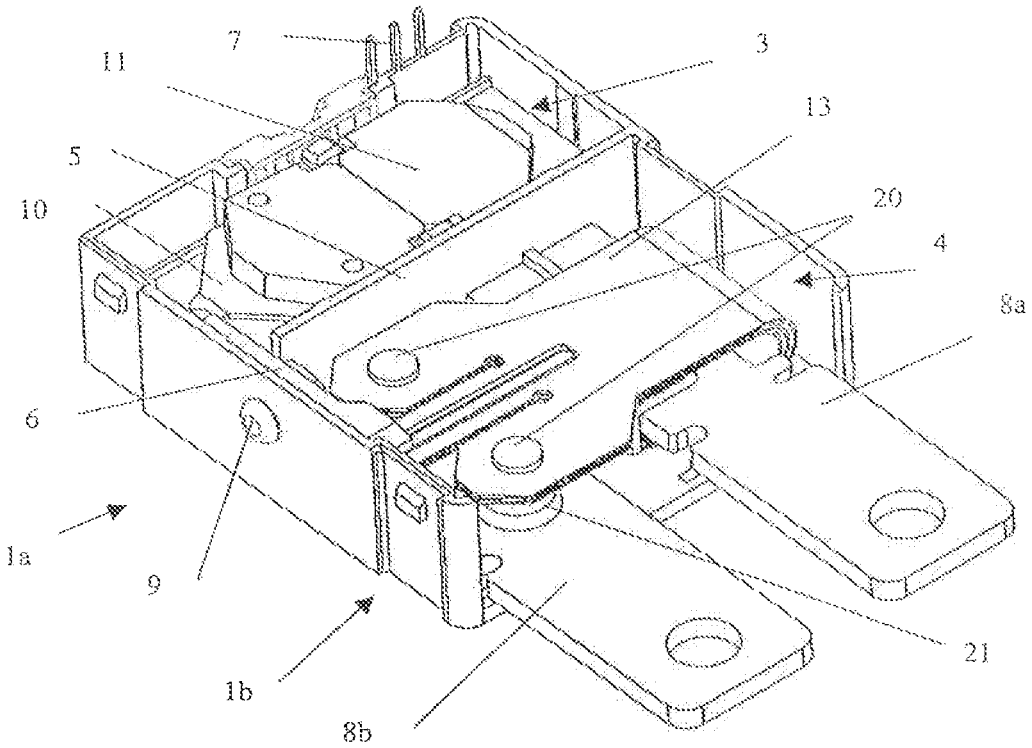
FIG. 7 a version of the relay with removed housing cap.

FIG. 7 shows another version of the relay. The relay has already been assembled excepting putting on the housing cap 2. The fundamental structure corresponds to that of the basic version to FIG. 1. But as distinct from FIGS. 1, 2, 5 and 6, a version of a contact assembly 4 is represented having two contacts 20 on the contact spring 13 and two fixed contacts 21 on the current bar 8*b*. If there are two contacts for one switching pole, the transition resistance between the contacts 20, 21 is cut in half, which has a positive effect on the heating, internal power consumption and service life of the contact system. The multiplate contact spring 13 is slotted at its contacts bearing end so that each of both movable contacts 20 is flexibly moving on its own, capable to compensate for any manufacture tolerances toward the fixed contacts 21. Moreover, the chatter liability, hence contact burn-up reduces. The dimensions of the two housing chambers 1*a*, 1*b* are not changed compared to the dimensions in FIG. 1. In the rotative bearing 9 at the level of the partition 5 the double-arm rocker element 6 is supported as driving device.

Figure 8:
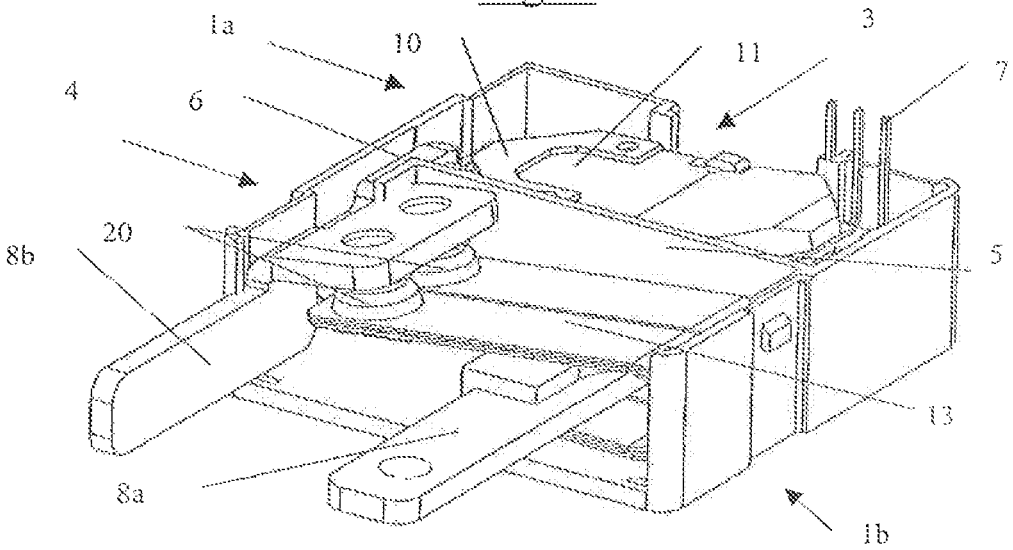
FIG. 8 a second version of the relay with removed housing cap.

In FIG. 8 another relay version is shown. The version comprises a long extending three-plate contact spring 13 bent U-shaped that is slotted longitudinally over a longer length to form two spring arms. Again the plates are connected to each other at both ends. The shorter U-leg of the contact spring 13 is mounted with its end to a current bar 8*a*, the longer U-leg of the contact spring 13 bears a movable contact 20 at each end of its spring arms. The movable contacts 20 interact with fixed contacts 21 attached to the second current bar 8*b*. In contrast to the previous contact assemblies the contacts 20, 21 are on the other switching side, away from the U-bend. For that, the current bar 8*b* bearing the fixed contacts 21 is offset in the housing chamber 1*b* for the contact assembly 4. In the shown closing position of the contacts 20, 21 a current flows over the first current bar 8*a*, the shorter U-leg of the contact spring 13, the U-bend zone of the contact spring 13, the longer U-leg of the contact spring 13, the contacts 20, 21 to the second current bar 8*b*. The U-shape of the contact spring 13 allows to achieve a force-way characteristic well-tuned to the actuator, despite of the short design length of the contact spring 13 and the high current carrying capacity required. This requirement is supported by the multiplate structure of the contact spring 13, wherein it is advantageous for the heat removal and flexibility of the contact spring 13 that the single plates of the contact spring 13 fan out in the U-bend zone due to their different lengths. Also here the single plates can be provided to have different flexibility and conductivity properties. Due to the U-shaped contact spring 13 the current flows through the contact spring sections that are parallel next to the other, of the U-legs in opposite directions. In the closed position of the contacts 20, 21, when high currents flow, the contacts 20, 21 are advantageously pressed onto each other, in addition to the contact force, by the occurring electrodynamic forces acting on the contact spring 13. Again a double-arm rocker element 6 serves to operate the contact spring 13 over the actuator assembly 3.

Figure 9:
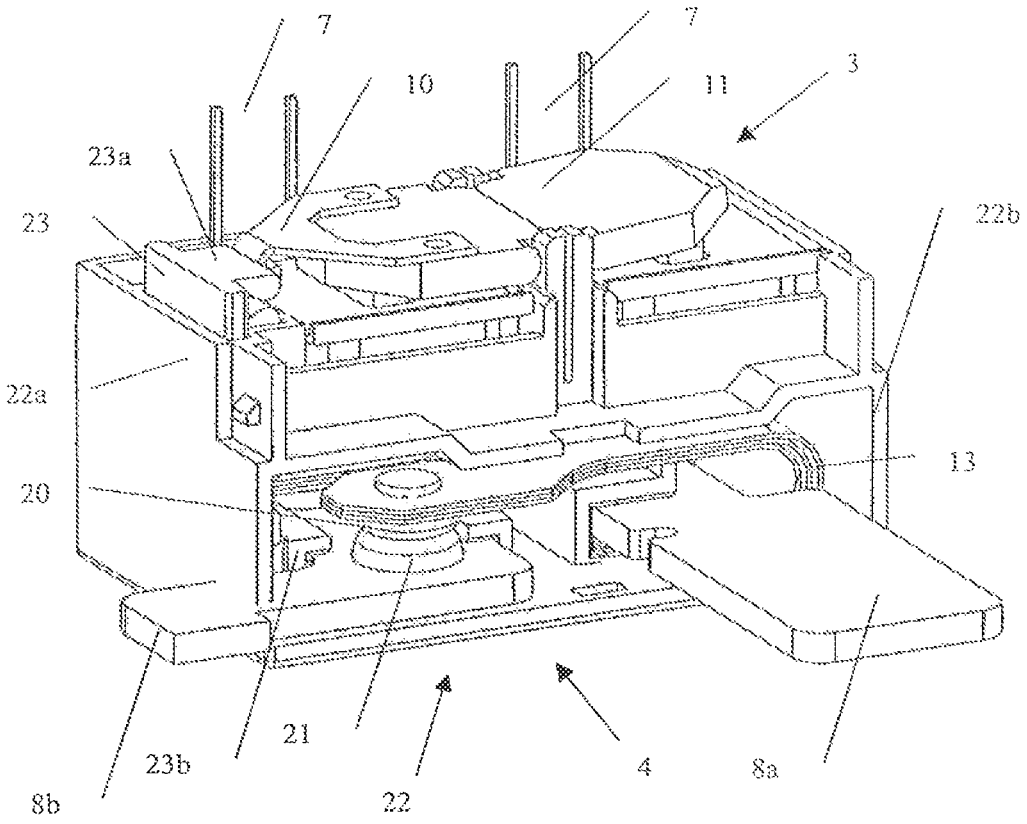
FIG. 9 a third version of the relay with removed housing cap.

Whereas in the FIGS. 1, 2, 7 and 8 relay versions were described with the actuator assembly 3 and the contact assembly 4 arranged in one plane in the insulation material housing, that is side by side in the housing chambers 1*a*, 1*b* of the housing bottom part 1, FIG. 9 shows another relay version with the actuator assembly 3 placed above the contact assembly 4 in the insulation material housing 1. The assemblies 3, 4 themselves basically have the same structure and same size compared to the previous assemblies. But in this example the current bars 8*a*, 8*b* are led out of the insulation material housing at right angle. Also the housing chambers 22*a*, 22*b* have the same dimensions. Now the insulation material housing 22 is no longer square in its cross-section but rectangular, the housing cap, not shown in detail, is L-shaped. The insulation material housing is twice as high and, therefore, half as wide as the insulation material housing having a square cross-section. The contact assembly 4 is inserted into the lower housing chamber 22*b*. The actuator assembly 3 is inserted into the upper housing chamber 22*a*. The driving device includes a slide 23 that on a narrow side is guided by contours of the housing bottom part 22*b*. The slide 23 has gripper arms 23*a*, 23*b* on both sides that grip, first, a force application member 10 of a rocker armature 11 of the actuator assembly 3 and second, a force application member 12 of a contact spring 13 of the contact assembly 4. A further special feature is that each excitation coil 17 is led to a couple of connector pins 7.

Figure 10:
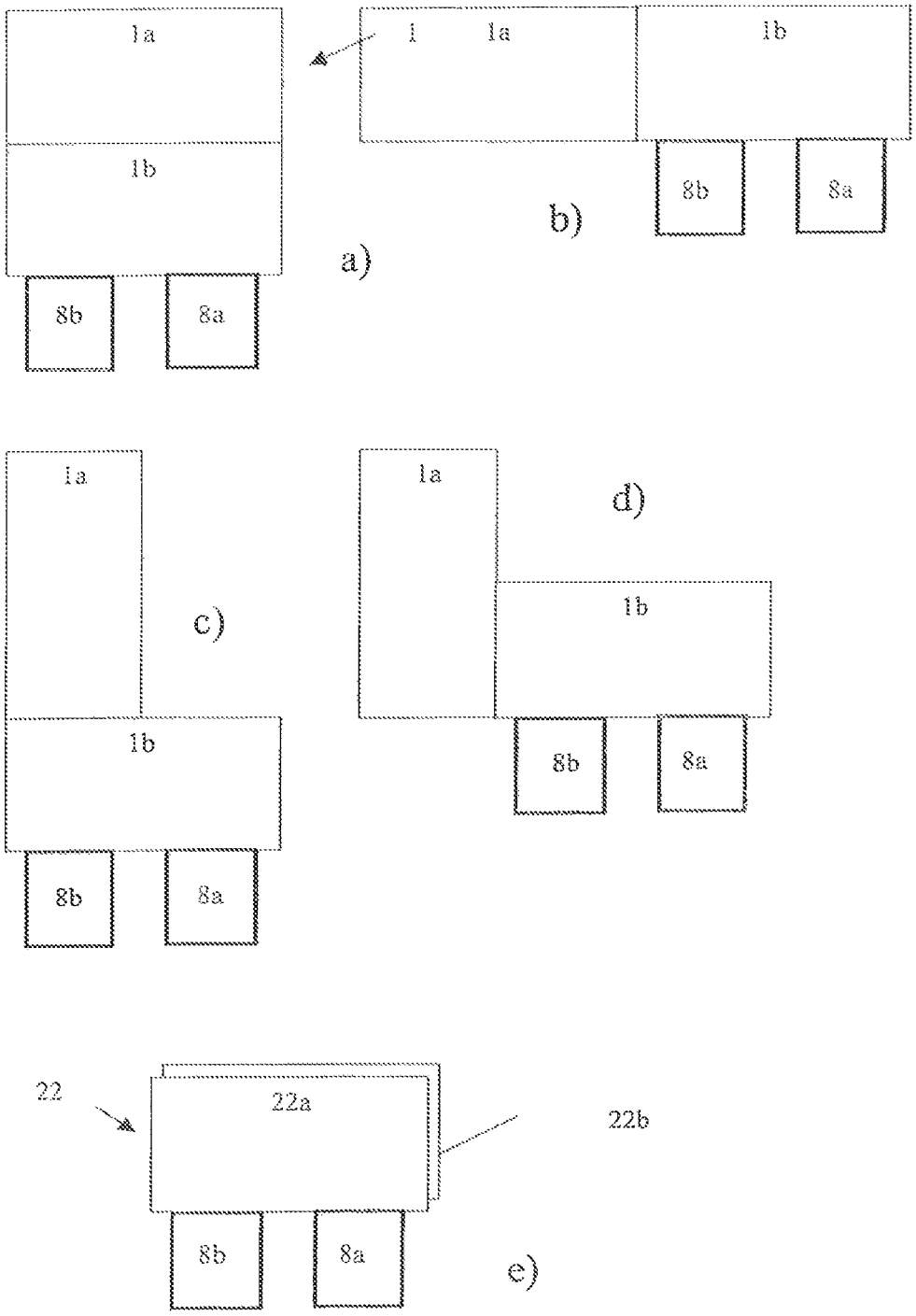
FIG. 10 schematically shown design versions of the relay according to the invention.

The assembly drawing with the FIGS. 10 *a*) to 10 *e*) shows purely schematically some versions of a relay structure, wherein to FIG. 10 *a*) to FIG. 10 *d*) the housing chamber 1*a* for the actuator assembly 3 and the housing chamber 1*b* for the contact assembly 4 are placed side by side in one plane in an insulation material housing in each case, but to FIG. 10 *e*) in two planes above each other. In the examples, the current bars 8*a*, 8*b* are in all versions led out parallel to each other. The relay arrangements to the FIGS. 1 *a*) and 1 *e*) are preferred because of the compact design. If the installation conditions, however, do not allow another option, a relay version to the FIGS. 10 *b*) to 10 *d*) can easily be used. Depending upon the demands of the individual versions, rockers, slides, levers, pins etc. can be used as driving devices, and the current bars 8*a*, 8*b* can be flat, raised on edge, parallel or at an angle to each other. For special cases of application relays can be made having one actuator assembly and more than one contact assembly. For example, following FIG. 10 *e*), relays with two contact assemblies located above each other can be configured, or following FIG. 10 *a*), relays with contact assemblies located on both sides of an actuator assembly. For example, the actuator assembly can actuate a make contact assembly and a break contact assembly. Also a switching over contact assembly can be configured in that on both sides of the contact spring there is a movable contact that interacts with a fixed contact each. In this case three current bars lead out of the insulation material housing.

NOMENCLATURE

1 square housing bottom part
1*a* housing chamber for actuator assembly
1*b* housing chamber for contact assembly
2 square housing cap
3 actuator assembly
4 contact assembly
5 partition
6 double-arm rocker element as driving device
6*a* gripper arm
6*b* gripper arm
7 connector pins
8*a* current bar
8*b* current bar with fixed contact
9 rotative bearing in the housing bottom part
10 force application member at the rocker armature
11 rocker armature
12 force application member at the contact spring
13 contact spring
14 U-shaped soft iron yoke
15 permanent magnet
16 central leg
17 excitation coils
18 insulating body
19 film hinge
20 movable contact
21 fixed contact
22 rectangular housing bottom part
22*a* upper housing chamber for the actuator assembly
22*b* lower housing chamber for the contact assembly
23 slide as driving device
23*a* upper gripper arm at the slide
23*b* lower gripper arm at the slide

The invention claimed is:

1. A bistable high-performance miniature relay, comprising a housing made of an insulation material having a cap and a bottom part, wherein the bottom part is divided by a partition into a first housing chamber and a second housing chamber, in the first housing chamber a single-phase contact assembly with two current bars and a multi plate contact spring is arranged, with the contact spring permanently connected with one leg end to one of the current bars, and with the other free leg end, bearing at least one mobile contact, works to at least one fixed contact that is seated on the second current bar, in the second housing chamber is a bistable magnetic actuator assembly, a driving device located in the housing displaces the contact spring in order to close or break an electric circuit over the current bars, wherein the contact assembly (4) and the actuator assembly (3) are located in one or in two planes in the insulation material housing, the multi plate contact spring (13) comprises a plurality of plates nested within each other and each of the plural plates being bent U-shaped to a current loop that uses the electrodynamic current forces, and the actuator assembly (3) is provided with a one-part U-shaped yoke (14) with at least one excitation coil (17) per yoke leg and a yoke central leg (16), borne by a flat permanent magnet, supporting a rocker armature (11) that is formed to be slightly V-shaped.

2. The bistable miniature relay of claim 1, wherein the two housing chambers (1*a*, 1*b*; 22*a*, 22*b*) provided within the insulation material housing for the contact assembly (4) and the actuator assembly (3) have the same basic dimensions in length, width and height.

3. The bistable miniature relay of claim 1, wherein the housing chamber (22*a*) for the actuator assembly (3) is placed in a plane above the housing chamber (22*b*) for the contact assembly (4) in the insulation material housing and the driving device is established as a slide (23) that is actuated by the rocker armature (11) of the actuator assembly (3) and translationally guided in the insulation material housing over both housing chambers (22*a*, 22*b*), the driving device displacing the free end of the contact spring (13).

4. The bistable miniature relay of claim 1, wherein the housing chamber (1*a*) for the actuator assembly (3) is placed laterally adjacent to the housing chamber (1*b*) for the contact assembly (4) in the insulation material housing and the driving device is established as a double-arm rocker element (6) actuated by the rocker armature (11) and supported in the insulation material housing, the rocker element (6) displacing the free end of the contact spring (13).

5. The bistable miniature relay of claim 1, wherein the multi plate contact spring (13) is longitudinally slotted over at least part of its free length to form two spring arms and each spring arm at the end bears a movable contact piece (20) for a corresponding fixed contact (21).

6. The bistable miniature relay of claim 1, wherein the contact spring plates are fanned out in the area of their U-bend zone.

7. The bistable miniature relay of claim 1, wherein at least one contact spring plate has higher flexibility properties compared to at least one other contact spring plate of higher current carrying capacity.

8. The bistable miniature relay of claim 1, wherein the at least one moveable contact (20) is seated on the inner or on the outer side of the contact spring end of the contact spring (13) and the current bar (8*b*) is supported with its at least one corresponding fixed contact (21) accordingly assigned in the housing chamber (1*b*; 22*b*) of the contact assembly (4).

9. The bistable miniature relay of claim 1, wherein for switching over the excitation coil (17) in the magnet branch closed over the rocker armature (11) is applied with such a direct voltage pulse that an electromagnetic displacement flux opposite to the permanent magnetic flux in this magnet branch is generatable.

10. The bistable miniature relay of claim 1, wherein in addition to the excitation coils (17) located on both yoke legs of the actuator assembly (3) another excitation coil is located on that yoke leg to the side of which the rocker armature (11) has to apply a higher switching-over force.

* * * * *